US006656346B2

(12) United States Patent
Ino et al.

(10) Patent No.: US 6,656,346 B2
(45) Date of Patent: Dec. 2, 2003

(54) FLUID CATALYTIC CRACKING PROCESS FOR HEAVY OIL

(75) Inventors: Takashi Ino, Tokyo (JP); Toshiaki Okuhara, Tokyo (JP); Mohammad Abul-Hamayel, Dhahran (SA); Abdullah Aitani, Dhahran (SA); Abdulgader Maghrabi, Dhahran (SA)

(73) Assignees: King Fahd University of Petroleum and Minerals, Dhahran (SA); Petroleum Energy Center, Tokyo (JP)

( * ) Notice: Subject to any disclaimer, the term of this patent is extended or adjusted under 35 U.S.C. 154(b) by 34 days.

(21) Appl. No.: 09/883,464

(22) Filed: Jun. 7, 2001

(65) Prior Publication Data

US 2003/0006168 A1 Jan. 9, 2003

(51) Int. Cl.[7] ..... C10G 11/00

(52) U.S. Cl. ..... 208/120.01; 208/113; 208/121; 585/653

(58) Field of Search ..... 208/113, 120.01, 208/121; 585/653

(56) References Cited

U.S. PATENT DOCUMENTS 3,074,878 A 1/1963 Pappas
4,419,221 A 12/1983 Castagnos et al.
4,980,053 A 12/1990 Li et al.
5,326,465 A 7/1994 Yongqing et al.
5,462,652 A 10/1995 Wegerer
5,951,850 A * 9/1999 Ino et al. ..... 208/113

FOREIGN PATENT DOCUMENTS

EP 315179 A 5/1989
EP 315 179 A 5/1989
JP 7506389 7/1995

* cited by examiner

*Primary Examiner*—Walter D. Griffin
*Assistant Examiner*—James Arnold, Jr.
(74) *Attorney, Agent, or Firm*—Dennison, Schultz & Dougherty

(57) ABSTRACT

A heavy fraction oil is catalytically cracked by contacting the oil with a catalyst mixture consisting of 60 to 95 wt % of a base cracking catalyst containing an ultra stable Y-type zeolite and less than 0.5 wt % of rare-earth metal oxide, and 5 to 40 wt % of an additive containing a shape-selective zeolite, in a fluid catalytic cracking apparatus under conditions that a reaction zone outlet temperature is in the range of 580 to 630° C., the catalyst/oil ratio is in the range of 15 to 40 wt/wt, and the contact time of hydrocarbons in the reaction zone is in the range of 0.1 to 1.0 seconds, wherein the yield of light-fraction olefins can be enhanced.

13 Claims, 1 Drawing Sheet

Ino, et al.

Fluid Catalytic Cracking Process for Heavy Oil

FIGURE 1: Ino, et al.
Fluid Catalytic Cracking Process for Heavy Oil
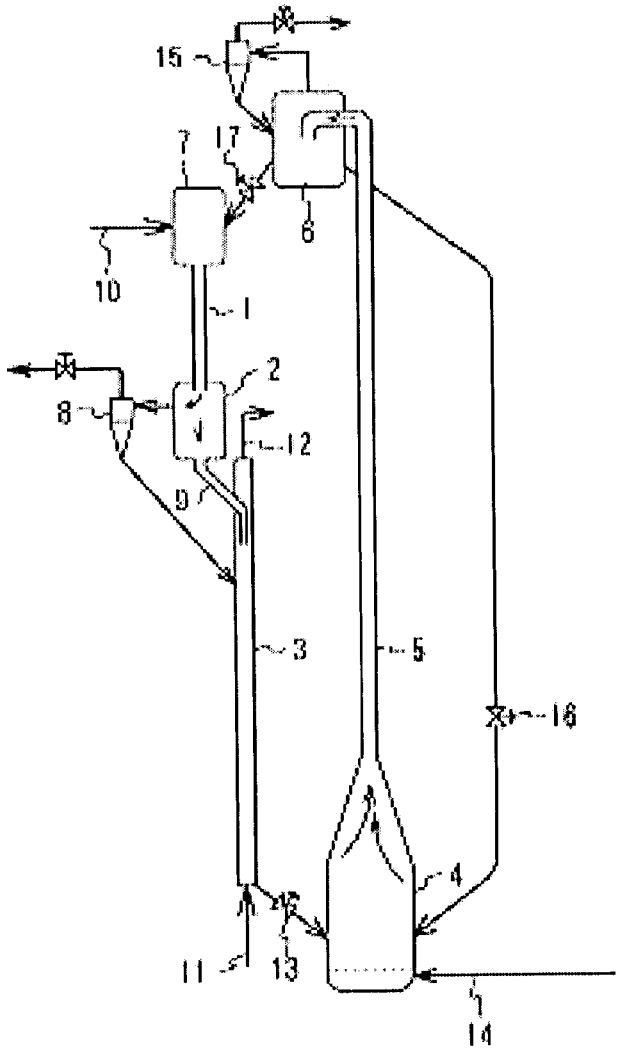

FLUID CATALYTIC CRACKING PROCESS FOR HEAVY OIL

BACKGROUND OF THE INVENTION

1. Field of the Invention

This invention relates to a process for catalytic cracking of a heavy-fraction oil. More particularly, it relates to a fluid catalytic cracking (FCC) process which comprises cracking a heavy-fraction oil to obtain light olefins such as ethylene, propylene, and butenes.

2. Description of the Prior Art

In the usual catalytic cracking technique, petroleum-derived hydrocarbons are catalytically cracked with a catalyst, thereby to obtain gasoline as the main product, a small amount of LPG, a cracked gas oil and the like, and coke deposited on the catalyst is then burnt away with air to recycle the regenerated catalyst for reuse.

In recent years, however, there has been a tendency that a fluid catalytic cracking apparatus is utilized not as an apparatus for producing gasoline, but as an apparatus for producing light-fraction olefins for use as petrochemical materials. Such utilization of an original fluid catalytic cracking apparatus as an olefin-producing apparatus is economically advantageous, particularly to an oil refinery which is highly integrated with a petrochemical industry.

On the other hand, much attention has been paid to environmental problems, and the regulation of the content of olefins and aromatics in gasoline for automobiles. Consequently, it can be anticipated that alkylate will be increasingly in demand as additive materials for high-octane gasoline, in place of FCC-produced gasoline and catalytically-reformed gasoline. Therefore, it will be necessary to increase the production of propylene and butenes which are raw materials for this additive.

Methods for producing the light-fraction olefins by the fluid catalytic cracking of heavy-fraction oils include methods which comprise contacting a feed oil with a catalyst for a short time (U.S. Pat. Nos. 4,419,221, 3,074,878, and 5,462,652, and European Patent No. EP 315,179A), a method which comprises carrying out a cracking reaction at a high temperature (U.S. Pat. No. 4,980,053), and methods which comprise using pentasil-type zeolites (U.S. Pat. No. 5,326,465 and Japanese Patent National Publication (Kohyo) No. Hei JP 7-506389).

Even these known methods still cannot produce sufficient light-fraction olefins selectively. For example, the high-temperature cracking reaction will result in a concurrent thermal cracking of heavy-fraction oils, thereby increasing the yield of dry gases from said oils. The short contact time of a feed oil with a catalyst will cause a decrease of conversion of light-fraction olefins to light-fraction paraffins due to its inhibition of a hydrogen transfer reaction, and it will be unable to increase conversion of heavy-fraction oils to light-fraction oils. Furthermore, the use of pentasil-type zeolites will only enhance the yield of light-fraction hydrocarbons by excessive cracking of the gasoline, once it is produced. Therefore, it is difficult to produce light-fraction olefins in a high yield from heavy fraction oils by using each of these known techniques alone.

BRIEF SUMMARY OF THE INVENTION

An objective of this invention is to provide an improved process for the fluid catalytic cracking of a heavy-fraction oil, which can produce light-fraction olefins with a high yield, while producing a diminished amount of dry gases such as gaseous hydrogen, methane, and ethane generated by the thermal cracking (thermocracking) of the heavy-fraction oil.

In an attempt to mainly raise the yield of light-fraction olefins, in a process employing fluid catalytic cracking of a heavy-fraction oil at a high temperature and at a short contact time, the present inventors have found that this objective can be achieved by contacting the heavy-fraction oil with a catalyst mixture, that consists of a specific base cracking catalyst and an additive containing a shape-selective zeolite, at a high temperature. This invention has been achieved on the basis of this finding.

More particularly, the process for fluid catalytic cracking of a heavy-fraction oil according to this invention comprises the step of contacting the heavy-fraction oil with a catalyst mixture, consisting of 60 to 95 wt % of a base cracking catalyst containing an ultra stable Y-type zeolite and less than 0.5 wt % of rare-earth metal oxide, and 5 to 40 wt % of an additive containing a shape-selective zeolite; the oil and the catalyst are contacted in a fluid catalytic cracking apparatus having a regeneration zone, a down flow-type reaction zone, a separation zone, and a stripping zone, and are contacted under conditions so that the reaction zone outlet temperature is in the range of 580 to 630° C.; the catalyst/oil ratio is in the range of 15 to 40 wt/wt, and the contact time of hydrocarbons in the reaction zone is in the range of 0.1 to 1.0 seconds.

DETAILED DESCRIPTION OF THE INVENTION

This invention will be described below in more detail.

Feed Oil

In the fluid catalytic cracking of this invention, a heavy-fraction oil is used as a feed oil. The heavy-fraction oil used preferably has a boiling point in the range of 250° C. or higher, at atmospheric pressure. The heavy-fraction oil used herein may include straight-run gas oil, vacuum gas oil, atmospheric residue, vacuum residue, coker gas oil, or heavy-fraction oils obtained by hydrofining said residues and gas oils. These aforementioned heavy-fraction oils may be used singly or jointly, or as a mixture thereof, with a minor portion of a light fraction oil.

Apparatus and Process

The fluid catalytic cracking apparatus which can be used in this invention has a regeneration zone (a regenerator), a down flow-type reaction zone (a downer reactor), a separation zone (a separator), and a stripping zone (a stripper). The term "fluid catalytic cracking" referred to herein indicates that the above described heavy-fraction oil, as the feed oil, is continuously brought into contact with a catalyst which is kept in a fluidized state under specific operating conditions, to crack the heavy-fraction oil, thereby producing light-fraction hydrocarbons, mainly comprising gasoline and light-fraction olefins.

In the reaction zone, the fluid catalytic cracking may be effected within a fluid bed, in which the catalyst particles are fluidized with the heavy-fraction oil, or, may be effected by employing so-called riser cracking, in which both the catalyst particles and the heavy-fraction oil ascend through a pipe, or, so-called down flow cracking in which both the catalyst particles and the heavy-fraction oil descend through a pipe. In case of riser cracking in a riser reactor, however, back-mixing of hydrocarbons takes place in the reactor, which causes localized long residence times of hydrocarbons in the reactor, resulting in enhancement of thermal cracking. Particularly, in fluid catalytic cracking processes, like this invention, operated with higher reaction temperatures than ordinary fluid catalytic cracking processes, thermal cracking caused by back-mixing is significant. With such an increase in the contribution of thermal cracking, the undesirable dry gases increase and the desirable gasoline and light-fraction olefins decrease. In this invention, therefore, the down flow-type reaction zone is employed to avoid thermal cracking.

The fluid catalytic cracking process of this invention will be described in detail. First, in the reaction zone, the heavy-fraction oil is continuously brought into contact with the catalyst mixture which is maintained in a fluidizing state, under the following specific operating conditions, to crack the heavy-fraction oil, thereby producing light-fraction hydrocarbons, mainly comprising light-fraction olefins. Then, a mixture of the catalysts and a hydrocarbon gas, comprising products (cracked products) obtained by the catalytic cracking, mixed with un-reacted materials, is forwarded into the separation zone, in which most of the catalyst is separated from the hydrocarbon gas.

Next, the separated catalysts are forwarded to the stripping zone, in which most of the heavy hydrocarbons comprising some of the products, and the un-reacted materials, which are adsorbed on the catalysts, are removed from the catalyst particles. The catalysts on which carbonaceous materials, and a portion of heavy hydrocarbons, are deposited, are forwarded from the stripping zone to the regenerating zone. In the regenerating zone, the catalysts, on which the carbonaceous materials and the like are deposited, are subjected to oxidation treatment, to decrease the amount of the deposits, thereby obtaining regenerated catalysts. These regenerated catalysts are continuously recycled to the reaction zone. In one particular case, the cracked products are quenched just upstream of, or just downstream of, the separator, in order to avoid unnecessary further cracking or excessive cracking.

BRIEF DESCRIPTION OF THE DRAWING

FIG. 1 is a schematic illustration of an example of a fluid catalytic cracking (FCC) apparatus. In this example, the fluid catalytic cracking apparatus has a down-flow type reaction zone.

This invention is more fully explained in the context of an FCC process. The drawing of this invention shows a typical FCC process arrangement. The description of this invention in the context of this specific process arrangement shown is not meant to limit it to the details disclosed therein. The principal components of the FCC arrangement shown in FIG. 1 consist of a reaction zone 1, a gas-solid separation zone 2, a stripping zone 3, a regeneration zone 4, a riser type regenerator 5, a catalyst hopper 6, and a mixing zone 7. The arrangement circulates catalyst and contacts feed in the manner hereinafter described.

An FCC feedstock such as heavy oil is charged to the mixing zone 7 through line 10, and there is mixed with the regenerated catalyst from the catalyst hopper 6. The mixture falls downward through the reaction zone 1, where the cracking reaction of heavy oil takes place under high reaction temperatures and at short contact time. Then, the mixture of spent catalyst and products, from the reaction zone 1, enters the gas-solid separation zone 2 located under the reaction zone 1. The spent catalyst is separated, in separation zone 2, from the cracked products and un-reacted feed oil. The catalyst is then sent to the upper portion of the stripping zone 3 through dip leg 9.

Hydrocarbon gases separated from most of the spent catalyst are sent to a secondary separator 8, where the rest of the spent catalyst is separated from the product gas. Hydrocarbon gases are then sent to a product recovery section. A tangential-type cyclone is preferred for use as the secondary separator 8.

Catalyst separated by the secondary separator 8 is directed to the stripping zone 3 where heavy hydrocarbons adsorbed on the catalyst are removed by a stripping gas introduced through line 11. Steam produced in a boiler, or an inert gas such as nitrogen, pressurized in a compressor, is preferably used as the stripping gas. As stripping conditions, a stripping temperature of 500 to 630° C. and a catalyst residence time of 1 to 10 minutes are preferred. Vapors of cracked products and un-reacted feed oil, stripped from the spent catalyst in the stripping zone 3, are withdrawn through line 12 located at the top of the stripping zone, together with the stripping gas. These gases are then sent to a product recovery section. The spent stripped catalyst is transferred to the regeneration zone through the line that has the first flow controller 13.

The superficial gas velocity in the stripping zone 3 is preferably maintained within the range of 0.05 to 0.4 m/s, in order to keep the fluidized bed in the stripping zone in a bubble phase. Since the gas velocity is relatively low within the bubble phase zone, the consumption of stripping gas can be minimized. Moreover, the range of operational pressure of the first flow controller 13 may be broad, during the bubble phase condition, due to the high bed density, and therefore the transportation of catalyst particles from the stripping zone 3 to the regeneration zone 4 is facilitated. Perforated trays or other internal structures can be used in the stripping zone 3 to improve stripping efficiency between the stripping gas and the catalyst.

The regeneration zone 4 is composed of a cone-shaped column connected at the top to a vertical line 5 (a riser-type regenerator). The tip angle of the cone is preferably in the range of 30° to 90°. The ratio of the cone height to the column diameter is preferably in the range of ½ to 2.

The spent catalyst is regenerated with a combustion gas (typically an oxygen-containing gas such as air) which is fed to the regeneration zone 4 through line 14. Regeneration is by completely burning, under fluidized conditions, the carbonaceous materials and heavy hydrocarbons which have been adsorbed on the spent catalyst. Catalyst regeneration temperature is normally in the range of 600° to 1000° C., preferably in the range of 650° to 750° C. Catalyst residence time in the regeneration zone 4 is in the range of 1 to 5 minutes, and the superficial gas velocity is preferably in the range of 0.4 to 1.2 m/s.

After regeneration of the spent catalyst in the regeneration zone 4, the regenerated catalyst in the upper portion of the turbulent-phase fluidized bed is transferred to a riser-type regenerator 5.

The ratio of the riser-type regenerator 5 diameter, to the diameter of the column located at the bottom region of the regeneration zone, is preferably in the range of ⅙ to ⅓. By adopting this diameter ratio, the superficial gas velocity in the regeneration zone 4 can be kept within 0.4 to 1.2 m/s, a velocity value which is appropriate to cause a turbulent fluidized bed. Moreover, the superficial gas velocity in the riser-type regenerator 5 can be kept within 4 to 12 m/s, a value which is appropriate for the upward transportation of the regenerated catalyst.

The regenerated catalyst from the riser-type regenerator 5 is carried to the catalyst hopper 6 located at the top of the riser type regenerator The catalyst hopper 6, which functions as a gas-solid separator, where the flue gases that contain the by-products of coke combustion are separated from the regenerated catalyst and removed through cyclone 15. The regenerated catalyst in catalyst hopper 6 is routed to the mixing zone 7 through a downer line equipped with a second flow controller 17. If necessary, a portion of the regenerated catalyst in the catalyst hopper 6 can be returned back to the regeneration zone 4 through a bypass line equipped with a third flow controller 16.

As described above, FCC catalyst circulates in the HS-FCC apparatus through a reaction zone 1, a gas-solid separation zone 2, a stripping zone 3, a regeneration zone 4, a riser-type regenerator 5, a catalyst hopper 6, and a mixing zone 7. The "reaction zone outlet temperature" referred to in this invention, means an outlet temperature of the down flow-type reaction zone, and it is the temperature before separation of the cracked products from the catalysts, or, in the case that they are quenched just upstream of the separator, it is the temperature before quenching thereof.

In this invention, the reaction zone outlet temperature is in the range of 580 to 630° C., preferably the range of 590° to 620° C. If the reaction zone outlet temperature is lower than 580° C. then the light-fraction olefins will not be obtained in a high yield, while if it is higher than 630° C. then the thermal cracking of heavy fraction oil which is fed, will be significant, thereby excessively increasing the amount of dry gases generated.

In this invention, the catalyst/oil ratio [a ratio of the amount of the catalyst mixture recycled (ton/hr) to a rate of the feed oil fed (ton/hr)] is in the range of 15 to 40 wt/wt, preferably in the range of 20 to 30 wt/wt. If the catalyst/oil ratio is less than 15 wt/wt, a catalyst-dense-phase temperature in the regenerating zone will arise, owing to the local heat balance, in which the deactivation of the catalyst is accelerated simultaneously with the feed oil being brought into contact with those catalyst particles having the higher temperature, with the result that the amount of dry gases generated by the thermal cracking of the feed oil increases excessively.

Furthermore, if the catalyst/oil ratio is more than 40 wt/wt, the amount of the catalyst recycled will excessively increase and, hence, the handling capacity of the regenerating zone will be required to be excessively increased, in order to provide for a catalyst residence time therein, necessary for the regeneration of the used catalyst in the regenerating zone.

The contact time referred to herein means either the time between the start of contact of the feed oil with the regenerated catalysts and the separation of the produced cracked products from the catalysts, or, the time between the start of contact of the feed oil with the regenerated catalysts and the quenching, in the case that the produced cracked products are quenched just upstream of the separation zone. In this invention, the contact time is in the range of 0.1 to 1.0 seconds, preferably in the range of 0.2 to 0.7 seconds. If the contact time is less than 0.1 seconds, then the light-fraction olefins will not be obtained at a high yield, because of low conversion of the heavy fraction oil, while conversely, if the contact time is longer than 1.0 sec, then the thermal cracking of heavy-fraction oil fed will be excessive, thereby excessively increasing the amount of dry gases generated.

In this invention, although operating conditions of the fluid catalytic cracking apparatus, except those described above, are not particularly restricted, the apparatus can be operated preferably at a reaction pressure of 1 to 3 $kg/cm^2G$, and at a regenerating zone temperature of 650 to 720° C.

The catalyst mixture which is used in this invention consists of a base cracking catalyst and a additive. The base cracking catalyst contains an ultra stable Y-type zeolite which is the main active component of the base catalyst, and a matrix which is a substrate material for the zeolite. The base cracking catalyst contains less than 0.5 wt % of rare-earth metal oxide that is mainly included in the ultra stable Y-type zeolite. Generally, catalytic activity of ultra stable Y-type zeolites increases, as the rare-earth metal content in the zeolites increases, because thermal stability of the ultra stable Y-type zeolite is improved by incorporating rare-earth metal into the zeolites.

On the other hand, hydrogen transfer reaction activity of Y-type zeolites is also increased by adding rare-earth metal to the zeolites. Olefins in catalytic cracking products decrease, and paraffins in catalytic cracking products increase, with increasing hydrogen transfer reaction activity of catalytic cracking catalysts. Olefins mainly contained in a gasoline fraction are cracked to light-fraction olefins on a catalyst additive that contains a shape selective zeolite, that will be described below. However, cracking of paraffins in a gasoline fraction on the shape-selective zeolite is much lower than cracking of olefins.

The production of light fraction olefins decreases with increasing hydrogen transfer reaction activity of base cracking catalysts. In this invention, the content of rare-earth metal oxide in the base cracking catalyst is less than 0.5 wt %, preferably less than 0.3 wt%, more preferably less than 0.1 wt %. If the content of rare-earth metal oxide in the base cracking catalyst is higher than 0.5 wt %, hydrogen-transfer reaction activity of the base cracking catalyst becomes too high, resulting in low light-fraction olefins yield, while the cracking activity of the base cracking catalyst is high.

The ultra stable Y-type zeolite, which is contained as an active component in the catalyst used in this invention, has a crystal lattice constant of preferably in a range of 24.30 to 24.60 Å, more preferably in a range of 24.36 to 24.45 Å. In this connection, the crystal lattice constant of the ultra stable Y-type zeolite is the value as measured in accordance with the specification ASTM D-3942-80. In this preferable range of the crystal lattice constant of the ultra stable Y-type zeolite, gasoline yield decreases and light fraction olefin yield increases, with decreasing the crystal lattice constant. However, if the crystal lattice constant is smaller than 24.30 Å, light-fraction olefin yield decreases, due to the low activity of the base cracking catalyst. The crystal lattice constant larger than 24.60 Å is not desirable, due to the high hydrogen transfer reaction activity of the base cracking catalyst.

The content of the ultra stable Y-type zeolite in the base cracking catalyst used in this invention is preferably in a range of 5 to 50 wt %, more preferably in the range of 15to40wt %.

The matrix of the base cracking catalyst used in this invention may include clays such as kaolin, montmorilonite, halloysite and bentonite, and inorganic porous oxides such as alumina, silica, boria, chromia, magnesia, zirconia, titania and silica-alumina. The base cracking catalyst used in this invention preferably has a bulk density of 0.5 to 1.0 g/ml, an average particle diameter of 50 to 90 microns, a surface area of 50 to 350 $m^2/g$ and a pore volume of 0.05 to 0.5 ml/g.

The catalyst mixture used in this invention contains, in addition to the base cracking catalyst, an additive containing a shape-selective zeolite. The shape selective zeolite referred to herein means a zeolite whose pore diameter is smaller than that of Y-type zeolite, so that hydrocarbons with only limited shape can enter the zeolite through its pores. As examples of the shape-selective zeolite, ZSM-5, omega, SAPO-5, SAPO-11, SAPO34, and pentasil-type aluminosilicates are given. ZSM-5 zeolite is most preferably used in this invention, among these shape-selective zeolites. The content of the shape-selective zeolite in the additive used in this invention is preferably in the range of 20 to 70 wt %, more preferably in the range of 30 to 60 wt %.

The additive used in this invention preferably has a bulk density of 0.5 to 1.0 g/ml, an average particle diameter of 50 to 90 microns, a surface area of 10 to 200 $m^2/g$ and a pore volume of 0.01 to 0.3 ml/g.

A percentage of the base cracking catalyst in the catalyst mixture used in this invention is in a range of 60 to 95 wt % and a percentage of the additive in the catalyst mixture used in this invention is in a range of 5 to 40 wt %. If the percentage of the base cracking catalyst is lower than 60 wt % or the percentage of additive is higher than 40 wt %, high light-fraction olefin yield cannot be obtained, because of low conversions of the feed oil. If the percentage of the base cracking catalyst is higher than 95 wt %, or the percentage of the additive is lower than 5 wt %, high light-fraction olefin yield cannot be obtained, while high conversion of the feed oil can be achieved.

DESCRIPTION OF THE PREFERRED EMBODIMENTS

Next, this invention will be described with reference to the following examples, but this invention should not be limited to these examples.

EXAMPLE 1

Catalytic cracking of a heavy oil was carried out by the use of an adiabatic down flow-type FCC pilot device. With regard to the scale of the device, the inventory (the amount of catalyst) was 5 kg and the feed oil rate was 1 kg/hr, and with regard to operation conditions, the reaction zone outlet temperature was 600° C., the reaction pressure was 1.0 $kg/cm^2G$, the catalyst/oil ratio was 30 wt/wt, the contact time was 0.5 seconds, and the dense phase temperature in the regenerating zone was 720° C. Catalyst A that contains 0.05 wt % of rare-earth metal oxide was used in this experiment as a base cracking catalyst. The crystal lattice constant of an ultra stable Y-type zeolite included in the base cracking catalyst (Catalyst A) was 24.40 Å An additive used in this experiment was a commercially available additive, Olefins-Max (Davison).

Prior to feeding the catalyst and the additive into the device, both were subjected to steaming at 810° C. for 6 hours with 100% steam, in order to bring them into a pseudo equilibrium state. After the steaming, the base cracking catalyst and the additive were mixed. The percentages of the base cracking catalyst and the additive in the catalyst mixture were 75 wt % and 25 wt %, respectively. The feed oil was a hydrodesulfurized Arabian Light vacuum gas oil. The results are shown in Table 1.

EXAMPLE 2

Catalytic cracking of a heavy oil was carried out by the use of the same device under the same operation conditions as Example 1. The feed oil was an unhydrotreated Daquing vacuum gas oil. The same base cracking catalyst and the same additive as described for Example 1 were used in this experiment. Prior to feeding the catalyst and the additive into the device, both were subjected to steaming at 810 ° C. for 6 hours with 100% steam in order to bring them into a pseudo-equilibrium state. After the steaming, the base cracking catalyst and the additive were mixed. The percentages of the base cracking catalyst and the additive in the catalyst mixture were 75 wt % and 25 wt %, respectively. The results are shown in Table 1.

EXAMPLE 3

Catalytic cracking of a heavy oil was carried out by the use of the same device and the same feed oil under the same operation conditions as Example 1. Catalyst B that contains 0.05 wt % of rare-earth metal oxide was used in this experiment as a base cracking catalyst. The crystal lattice constant of an ultara stable Y-type zeolite included in the base cracking catalyst (Catalyst B) was 24.55 Å The same additive as described for Example 1 was used in this experiment. Prior to feeding the catalyst and the additive into the device, both were subjected to steaming at 810° C. for 6 hours with 100% steam in order to bring them into a pseudo-equilibrium state. After the steaming, the base cracking catalyst and the additive were mixed. The percentages of the base cracking catalyst and the additive in the catalyst mixture were 75 wt % and 25 wt %, respectively. The results are shown in Table 1.

COMPARATIVE EXAMPLE 1

Catalytic cracking of a heavy oil was carried out by the use of the same device and the same feed oil under the same operation conditions as Example 1. A base cracking catalyst used in this experiment was Catalyst A. No additive was used in this experiment. Prior to feeding the catalyst into the device, it was subjected to steaming at 810°C. for 6 hours with 100% steam in order to bring it into a pseudo-equilibrium state. The results are shown in Table 1.

COMPARATIVE EXAMPLE 2

Catalytic cracking of a heavy oil was carried out by the use of the same device and the same feed oil under the same operation conditions as Example 1. Catalyst C that contains 3.5 wt % of rare-earth metal oxide was used in this experiment as a base cracking catalyst. The crystal lattice constant of an ultra stable Y-type zeolite included in the base cracking catalyst (Catalyst C) was 24.55 Å The same additive as described for Example 1 was used in this experiment. Prior to feeding the catalyst and the additive into the device, both were subjected to steaming at 810° C. for 6 hours with 100% steam in order to bring them into a pseudo-equilibrium state. After the steaming, the base cracking catalyst and the additive were mixed. The percentages of the base cracking catalyst and the additive in the catalyst mixture were 75 wt % and 25 wt %, respectively. The results are shown in Table 1.

COMPARATIVE EXAMPLE 3

Catalytic cracking of a heavy oil was carried out by the use of an adiabatic up flow-type FCC pilot device. With regard to the scale of the device, the inventory (the amount of catalyst) was 3 kg and the feed oil rate was 1 kg/hr, and with regard to operation conditions, the reaction zone outlet temperature was 600° C., the reaction pressure was 1.0 $kg/cm^2G$, the catalyst/oil ratio was 10 wt/wt, the contact time was 1.5 seconds, and the dense phase temperature in the regenerating zone was 720° C. The same base cracking catalyst and the same additive as described for Example 1 were used in this experiment. Prior to feeding the catalyst and the additive into the device, both were subjected to steaming at 810° C. for 6 hours with 100% steam in order to bring them into a pseudo-equilibrium state. After the steaming, the base cracking catalyst and the additive were mixed. The percentages of the base cracking catalyst and the additive in the catalyst mixture were 75 wt % and 25 wt %, respectively. The results are shown in Table 1.

TABLE 1

| | Examples | | |
|---|---|---|---|
| | 1 | 2 | 3 |
| Base Cracking Catalyst (wt %) | A (75) | A (75) | B (75) |
| Additive (wt %) | OlefinsMax (25) | OlefinsMax (25) | OlefinsMax (25) |
| Feed Oil | Arabian Light Hydrotreated VGO | Daquing Unhydrotreated VGO | Arabian Light Hydrotreated VGO |
| Reaction Zone Type | Down flow | Down flow | Down flow |
| Reaction Zone Temperature ° C. | 600 | 600 | 600 |
| Catalyst Oil Ratio, wt/wt | 30 | 30 | 30 |
| Contact time, sec | 0.5 | 0.5 | 0.5 |
| Conversion, wt % | 85.5 | 91.3 | 89.1 |
| Yields, wt % | | | |
| Dry gas | 6.5 | 5.1 | 5.3 |
| Propylene | 20.7 | 23.8 | 19.9 |
| Butenes | 17.4 | 19.7 | 17.2 |
| Gasoline | 33.6 | 33.1 | 35.9 |
| LCO+ | 14.5 | 8.7 | 10.9 |
| Coke | 2.9 | 3.5 | 4.3 |

| | Comparative Examples | | |
|---|---|---|---|
| | 1 | 2 | 3 |
| Base Cracking Catalyst (wt %) | A (100) | C (75) | A (75) |
| Additive (wt %) | (0) | OlefinsMax (25) | OlefinsMax (25) |
| Feed Oil | Arabian Light Hydrotreated VGO | Arabian Light Hydrotreated VGO | Arabian Light Hydrotreated VGO |
| Reaction Zone Type | Down flow | Down flow | Down flow |
| Reaction Zone Temperature ° C. | 600 | 600 | 600 |
| Catalyst Oil Ratio, wt/wt | 30 | 30 | 10 |
| Contact time, sec | 0.5 | 0.5 | 0.5 |
| Conversion, wt % | 86.7 | 91.1 | 83.6 |
| Yields, wt % | | | |
| Dry gas | 5.4 | 4.4 | 8.3 |
| Propylene | 11.4 | 16.7 | 17.7 |
| Butenes | 14.9 | 14.6 | 15.8 |
| Gasoline | 46.6 | 38.7 | 32.5 |
| LCO+ | 13.3 | 8.9 | 16.4 |
| Coke | 3.8 | 7.2 | 4.2 |

It is apparent from the above-mentioned results that when a mixture of a base cracking catalyst containing less amount of rare-earth metal oxide, and an additive containing a shape-selective zeolite, are used as a catalyst for catalytic cracking of a heavy oil in a fluid catalytic cracking apparatus operated at high reaction temperature and with short contact time, the yield of light-fraction olefins will be high. Furthermore, a down low-type reaction zone is superior to an up low-type reaction zone for this purpose.

According to the process of this invention for fluid catalytic cracking of a heavy-fraction oil, the yield of light-fraction olefins can be increased.

What is claimed is:

1. A process for the fluid catalytic cracking of a heavy-fraction oil, which comprises contacting the oil with a catalyst mixture consisting of 60 to 95 wt % of a base cracking catalyst containing an ultra stable Y-type zeolite having a crystal lattice constant of greater than 24.55 Å to 24.60 Å, and less than 0.5 wt % of rare-earth metal oxide, and 5 to 40 wt % of an additive containing a shape-selective zeolite; said additive having a bulk density of 0.5 to 1.0 g/ml, an average particle diameter of 50 to 90 microns, a surface area of 10 to 200 $m^2/g$ and a pore volume of 0.01 to 0.3 ml/g;

wherein said contacting takes place in a fluid catalytic cracking apparatus having a regeneration zone, a down flow reaction zone, a separation zone and a stripping zone, and under conditions that the reaction zone outlet temperature is in the range of 580 to 630° C., the catalyst/oil ratio is in the range of 15 to 40 wt/wt, and the contact time of hydrocarbons in the reaction zone is in the range of 0.1 to 1.0 sec.

2. The process according to claim 1 wherein the reaction zone outlet temperature is in the range of 590 to 620° C.

3. The process according to claim 1 wherein the contact time of hydrocarbons in the reaction zone is in the range of 0.2 to 0.7 seconds.

4. The process according to claim 1 wherein the fluid catalytic cracking apparatus is operated at the reaction pressure of 1 to 3 $kg/cm^2G$.

5. The process according to claim 1 wherein the fluid catalytic cracking apparatus is operated with the catalyst/oil ratio of 20 to 30 wt/wt.

6. The process according to claim 1 wherein the rare-earth metal oxide content in the base cracking catalyst is less than 0.3 wt %.

7. The process according to claim 1 wherein the rare-earth metal oxide content in the base cracking-catalyst is less than 0.1 wt %.

8.The process according to claim 1 wherein the zeolite content in the base cracking catalyst is in the range of 5 to 50 wt %.

9. The process according to claim 1 wherein the zeolite content in the base cracking catalyst is in the range of 15 to 45 wt %.

10. The process according to claim 1 wherein the shape-selective zeolite contained in the additive is ZSM-5.

11. The process according to claim 1 wherein the shape-selective zeolite content in the additive is in the range of 20 to 70 wt %.

12. The process according to claim 1 wherein the shape-selective zeolite content in the additive is in the range of 30 to 60 wt %.

13. The process according to claim 1 wherein the shape-selective zeolite is selected from the group consisting of ZSM-5, omega, SAPO-5, SAPO-11, SAPO34 and pentasil aluminosilicates.

* * * * *